US005228628A

United States Patent [19]

Temburg et al.

[11] Patent Number: 5,228,628

[45] Date of Patent: Jul. 20, 1993

[54] APPARATUS FOR REMOVING TIES AND/OR WRAPPERS FROM FIBER BALES

[75] Inventors: Josef Temburg, Jüchen; Andreas Kranefeld, Erkelenz; Abi Marom, Mönchengladbach, all of Fed. Rep. of Germany

[73] Assignee: Trützschler GmbH & Co. KG, Mönchengladbach, Fed. Rep. of Germany

[21] Appl. No.: 745,201

[22] Filed: Aug. 15, 1991

[30] Foreign Application Priority Data

Aug. 16, 1990 [DE] Fed. Rep. of Germany ..... 4025889
Jun. 11, 1991 [DE] Fed. Rep. of Germany ..... 4119158

[51] Int. Cl.[5] ..... B65B 69/00

[52] U.S. Cl. ..... 241/101.4; 29/426.4; 414/412; 414/416

[58] Field of Search ..... 241/101.4; 414/411, 414/412, 416; 29/426.4, 822

[56] References Cited

U.S. PATENT DOCUMENTS

| | | | |
|---|---|---|---|
| 2,820,282 | 1/1958 | Schneider, Jr. . | |
| 3,513,522 | 5/1970 | Thomson . | |
| 4,219,299 | 8/1980 | Watson | 414/412 |

FOREIGN PATENT DOCUMENTS

| | | |
|---|---|---|
| 0251414 | 1/1988 | European Pat. Off. . |
| 0257563 | 3/1988 | European Pat. Off. . |
| 0260914 | 3/1988 | European Pat. Off. . |
| 2821336 | 10/1979 | Fed. Rep. of Germany . |
| 3504768 | 8/1985 | Fed. Rep. of Germany . |
| 3545659 | 6/1987 | Fed. Rep. of Germany . |
| 3727364 | 3/1988 | Fed. Rep. of Germany . |
| WO87/03556 | 6/1987 | PCT Int'l Appl. . |
| 2170093 | 7/1986 | United Kingdom . |

*Primary Examiner*—Douglas D. Watts
*Attorney, Agent, or Firm*—Spencer, Frank & Schneider

[57] ABSTRACT

An apparatus for removing severed ties and wrapper from a fiber bale includes a first device for pulling the severed ties and wrapper off the fiber bale; and a second device for taking over the ties and wrapper from the first device and for conveying the ties and wrapper away from the fiber bale.

15 Claims, 7 Drawing Sheets

APPARATUS FOR REMOVING TIES AND/OR WRAPPERS FROM FIBER BALES

CROSS REFERENCE TO RELATED APPLICATIONS

This application claims the priority of German Application Nos. P 40 25 889.0 filed Aug. 16, 1990 and P 41 19 158.7 filed Jun. 11, 1991, which are incorporated herein by reference. This application further contains subject matter related to U.S. application filed concurrently with this application and being based on German Applications P 45 25 890.4 filed Aug. 16, 1990 and P 41 19 336.9 filed Jun. 12, 1991.

BACKGROUND OF THE INVENTION

This invention relates to an apparatus for removing ties, such as wires, straps, bandages or the like and/or wrappers from textile fiber bales, particularly cotton bales or chemical fiber bales, wherein the apparatus and the bales are movable relative to one another.

In a known apparatus of the above-outlined type, such as described in German Offenlegungsschrift (application published without examination) 37 27 364, for the bales a conveyor belt is provided which has barbs on its surface. Further, arrangements are known where rotary discs are provided which have teeth or brushes along their circumference. It is a disadvantage of such prior art structures that the barbs, teeth or brushes do not securely ensnare the ties or wrappers or do not release them in a reliable manner, resulting in disturbances in an automatic operation.

SUMMARY OF THE INVENTION

It is an object of the invention to provide an apparatus of the above-outlined type from which the discussed disadvantages are eliminated and which thus securely grasps and conveys ties or wrappers away from the bales.

This object and others to become apparent as the specification progresses, are accomplished by the invention, according to which, briefly stated, the apparatus for removing severed ties and wrapper from a fiber bale includes a first device for pulling the severed ties and wrapper off the fiber bale; and a second device for taking over the ties and wrapper from the first device and for conveying the ties and wrapper away from the fiber bale.

Thus, according to the invention, the severed ties and/or wrappers are securely grasped and moved away from the fiber bales.

DESCRIPTION OF THE PREFERRED EMBODIMENTS

Figure 1A:
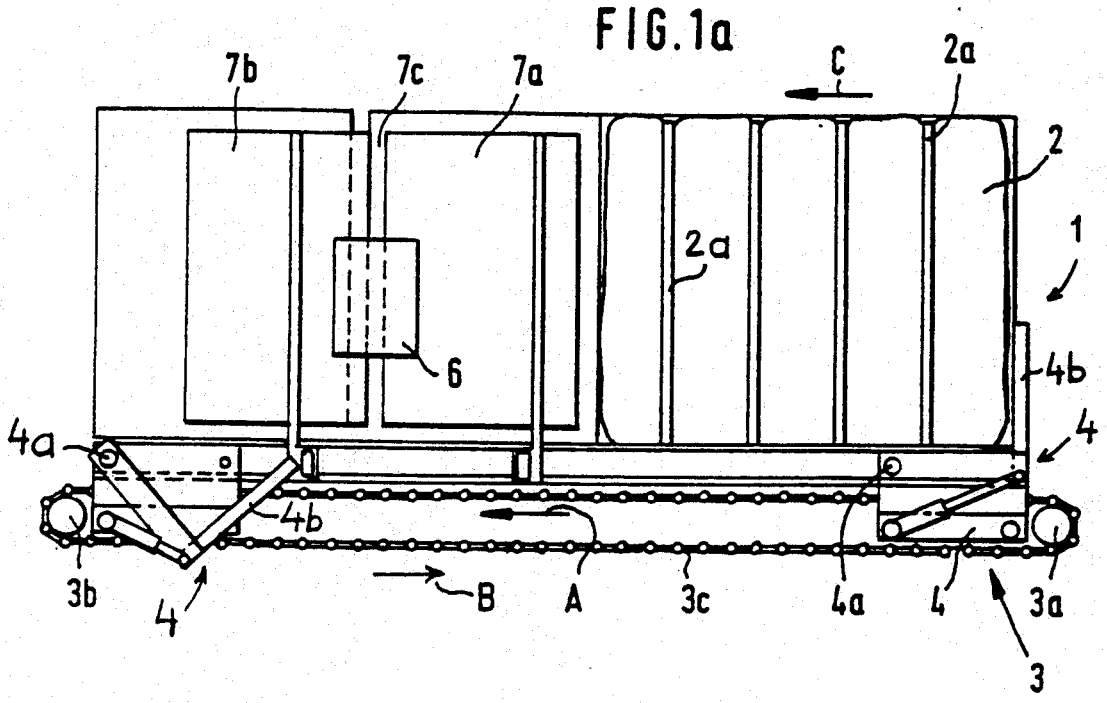
FIG. 1*a* is a schematic side elevational view of a preferred embodiment of a pull-off device according to the invention, shown in conjunction with a fiber bale conveying device.
Figure 1B:
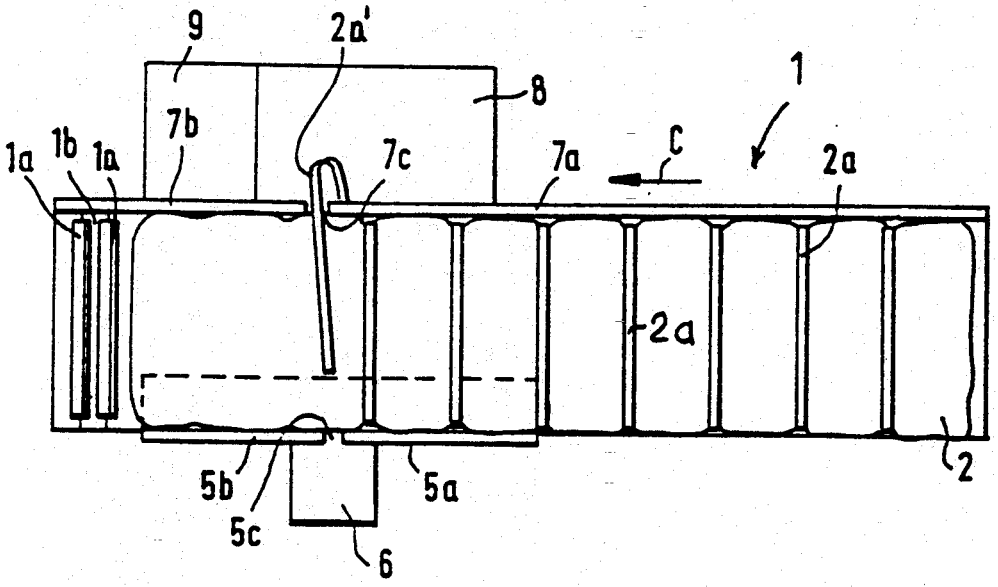
FIG. 1*b* is a schematic top plan view of the structure illustrated in FIG. 1*a*.

FIGS. 1*a* and 1*b* show a bale advancing device 1 including a roller track which is formed of rollers 1*a* spaced from one another at a distance 1*b* and on which a series of fiber bales 2 is supported. The bale advancing device 1 further includes a conveyor 3 which is arranged laterally of the roller track and which includes two end rollers 3*a* and 3*b* supporting a circulating conveyor element, such as a chain 3*c* for travel as indicated by arrows A and B to advance the bales 2 in the direction C. To the chain 3*c* there is secured a pusher assembly 4 which has a bale pusher element 4*b* rotatable into and out of an operative position about a pivot 4*a*.

As shown in FIG. 1*b*, between two serially arranged, aligned side walls 5*a* and 5*b* a clearance 5*c* is provided, in the zone of which a stationary cutting device 6, such as shears, is situated for severing ties 2*a* and/or a wrapper. On the opposite side of the roller track, facing the side walls 5*a* and 5*b*, there are provided two further side walls 7*a* and 7*b* spaced at a clearance 7*c* from one another. On the outside of the clearance 7*c* there is situated a stationary pull-off device 8 which is designed according to the invention and downstream of which a winding apparatus 9 is provided for removing the pulled-off ties 2*a*. FIG. 1*b* shows a tie 2*a*', severed by the cutting device 6 and being partially drawn off by the device 8.

Figure 2:
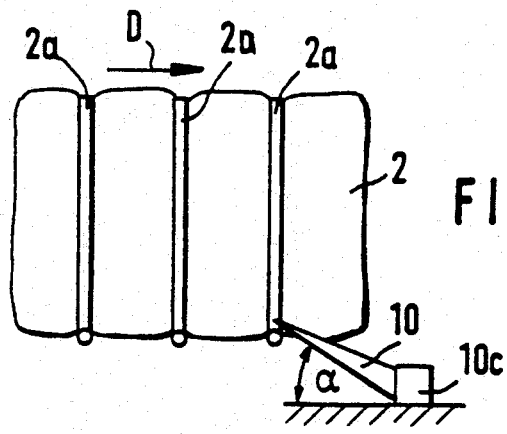
FIG. 2 is a side elevational view of a wrapperless fiber bale surrounded by ties and showing a tie-loosening fixed spike.
Figure 2A:
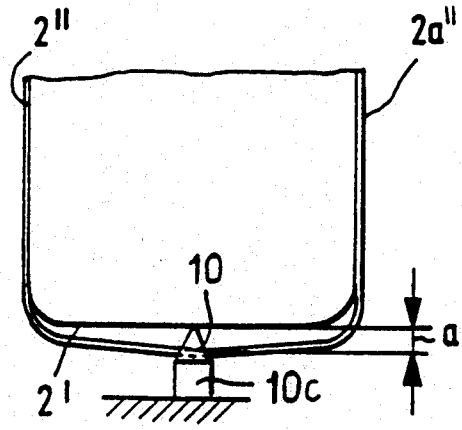
FIG. 2*a* is an end elevational view of a fiber bale of FIG. 2 showing separation of the tie from the bale with the aid of the spike.

Turning to FIGS. 2 and 2*a*, there is illustrated a stationary spike 10 which penetrates into the fiber bale 2 underneath a bale tie 2*a* and engages the same (FIG. 2). As the bale travels in the direction of the arrow D, a previously severed tie 2*a*'' rides up on the flank of the spike 10 which is oriented at an angle $\alpha$ opposite the bale advancing direction D. In this manner the ties 2*a* are separated by a distance a from the bale surface 2' as shown in FIG. 2a. Thereafter, the ties 2a may be pulled off by a tie removing device 12, 13 as will be described later in connection with FIGS. 5a, 5b, 5c, 9a and 9b.

Figure 3:
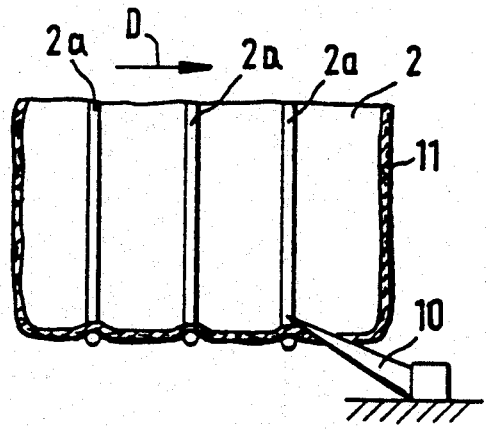
FIG. 3 is a partially sectional view of a fiber bale with wrapper, surrounded by ties and shown with a stationary spike penetrating underneath a tie and the wrapper.

In FIG. 3, there is shown a fiber bale 2 surrounded by a wrapper 11 which, in turn, is surrounded by ties 2a. The spike 10 extends under and engages both the wrapper 11 and—sequentially—the ties 2a.

Figure 4:
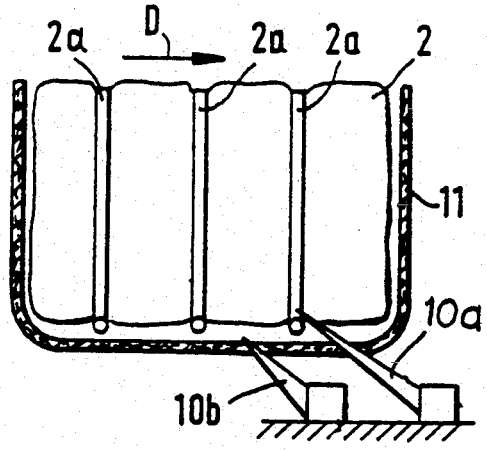
FIG. 4 is a side elevational view of a fiber bale provided with ties and being surrounded by a wrapper, further illustrated with two stationary, penetrating spikes.

FIG. 4 shows a fiber bale 2 which has a wrapper 11 (such as a sack) surrounding the securing ties 2a. Two fixed spikes 10a and 10b are provided; the spike 10a serves for penetrating below and thus engaging the tie 2a, while the spike 10b serves for penetrating into and thus engaging the wrapper 11.

Figure 5A:
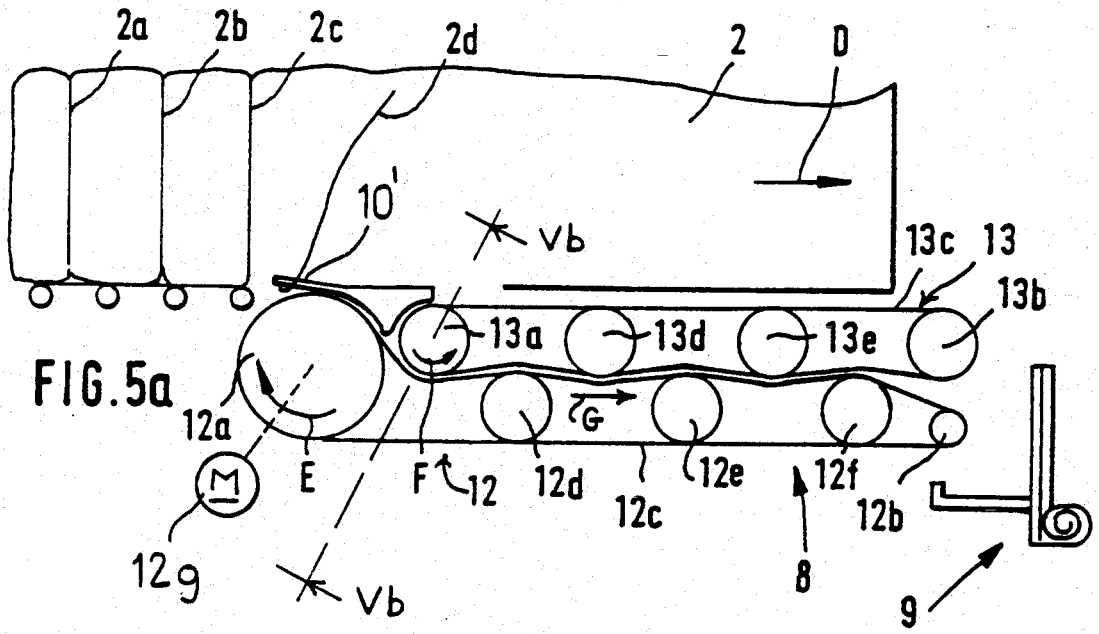
FIG. 5*a* is a schematic top plan view of a pull-off device including a penetrating spike and two cooperating conveyor belts.
Figure 5B:
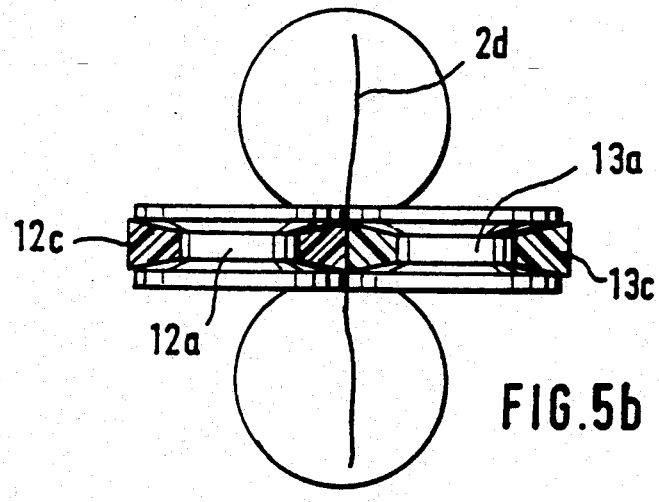
FIG. 5*b* is an enlarged sectional view taken along line Vb—Vb of FIG. 5*a*.
Figure 5C:
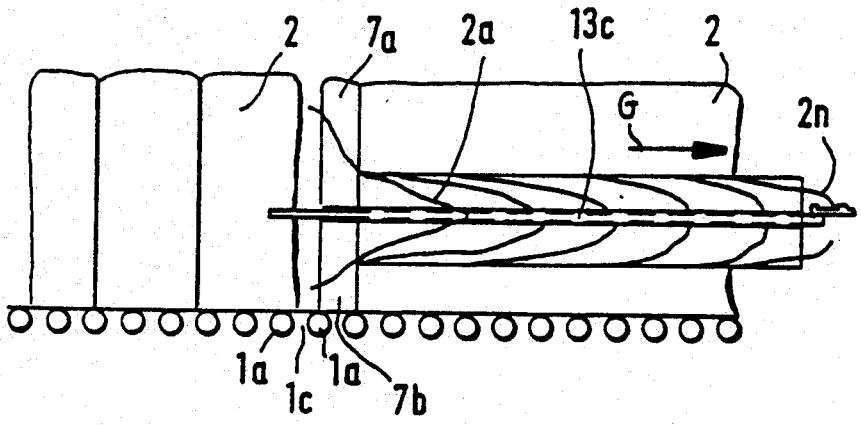
FIG. 5*c* is a schematic side elevational view similar to FIG. 5*a* illustrating a phase in which the ties are being drawn off.
Figure 5D:
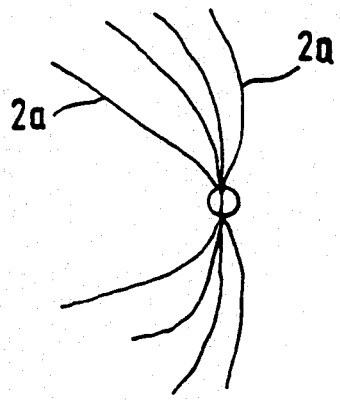
FIG. 5*d* shows a plurality of bunched, severed ties.

Turning to FIG. 5a, laterally of the bales 2 a pull-off device 8 is arranged which includes a spike 10' and two cooperating removal conveyor assemblies 12 and 13. Also referring to FIG. 5b, the conveyor assembly 12 includes an endless conveyor belt 12c having a wedge-shaped cross section and being supported by end pulleys 12a, 12b. The arrow E shows the direction of rotation of the end pulley 12a. Between the end pulleys 12a and 12b guide rollers 12d, 12e and 12f are shown. Similarly, the belt conveyor 13 includes two end pulleys 13a, 13b and a cross-sectionally wedge-shaped endless conveyor belt 13c supported by the end pulleys 13a, 13b. The arrow F indicates the direction of rotation of the end pulley 13a. Between the end pulleys 13a and 13b guide rollers 13d and 13e are provided. Downstream of the end rollers 12b and 13b, as viewed in the direction of bale advance D, a winding device 9 for treating the removed ties 2a is provided. The severed ties 2a and/or the wrapper 11 are pulled off on the underside through the clearance 1c between two adjoining rollers 1a of the roller track 1 and are advanced into the nip between the two co-travelling, superposed working flights of the cooperating belts 12c, 13c to be further conveyed thereby as indicated by the arrow G. The conveyor assemblies 12, 13 may be driven by a motor 12g connected to the end roller 12a.

Figure 9A:
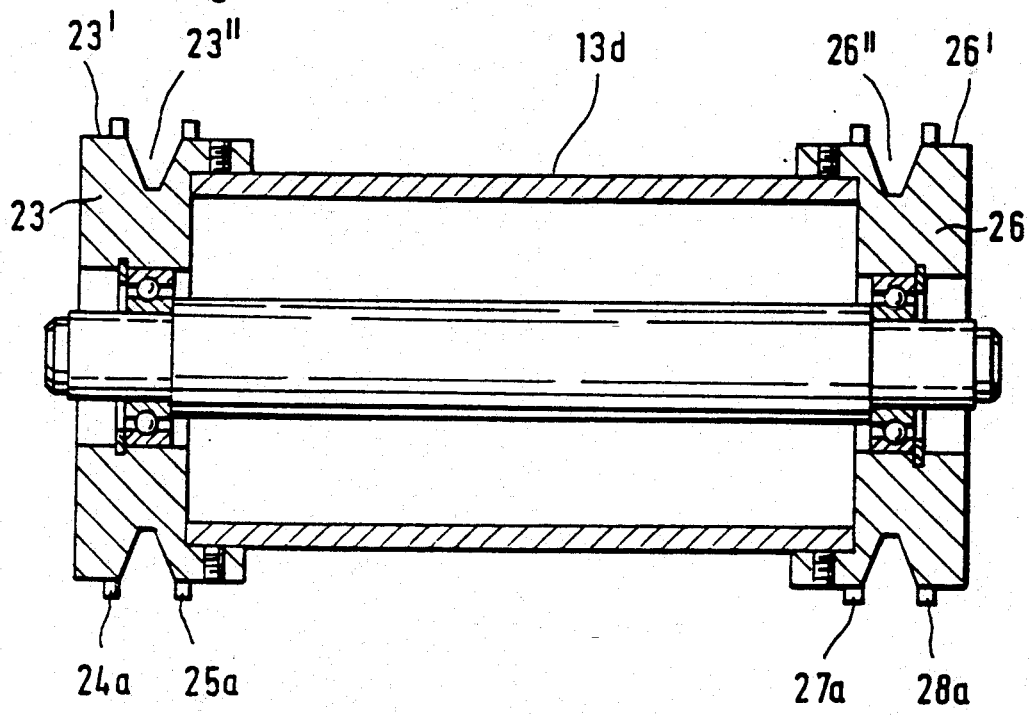
FIG. 9*a* is an enlarged axial sectional view of a modified roller component of the construction shown in FIG. 5*a*.
Figure 9B:
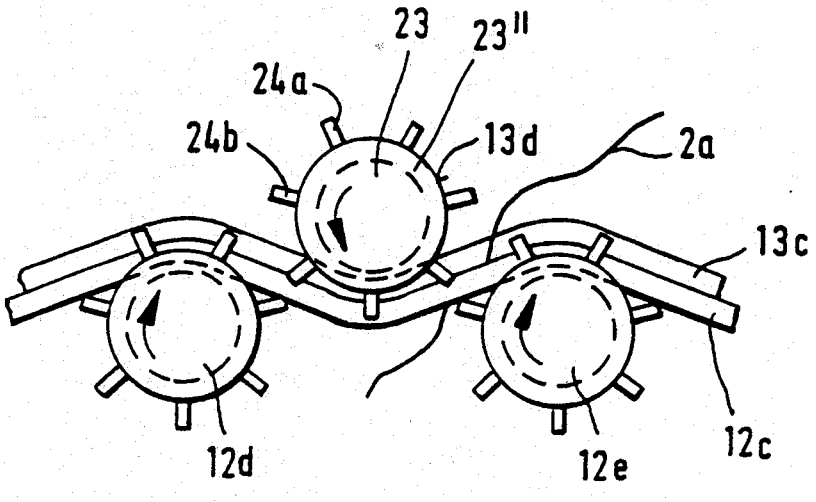
FIG. 9*b* is an enlarged schematic top plan view of modified components of the construction of FIG. 5*a*.

In the embodiment shown in FIGS. 9a and 9b, the guide roll 13d has two axially aligned belt pulleys 23 and 26. On the circumferential surfaces 23' and 26' of the respective pulleys 23 and 26, on each side of the wedge-shaped grooves 23" and 26", a plurality of tie-carrier pins 24a, 25a and 27a, 28a is arranged which extend radially outwardly from the respective circumferential surface 23', 26'. The other guide rolls 12d, 12e, 12f, 13a and 13e are structured similarly to the guide roll 13d. As shown in FIG. 9b, between the vertically arranged guide rollers 12d, 12e and 13d the two cross-sectionally wedge-shaped belts 12c and 13c are, by means of the ties 2a, squeezed or laterally pushed out of the respective grooves 23", 26". The remaining free intermediate axial spaces between the pins 24, 25 and 27, 28 permit the ties 2a to be received and conveyed further in an unimpeded manner. The belts 12c and 13c project beyond the respective grooves 23" and 26".

Figure 6:
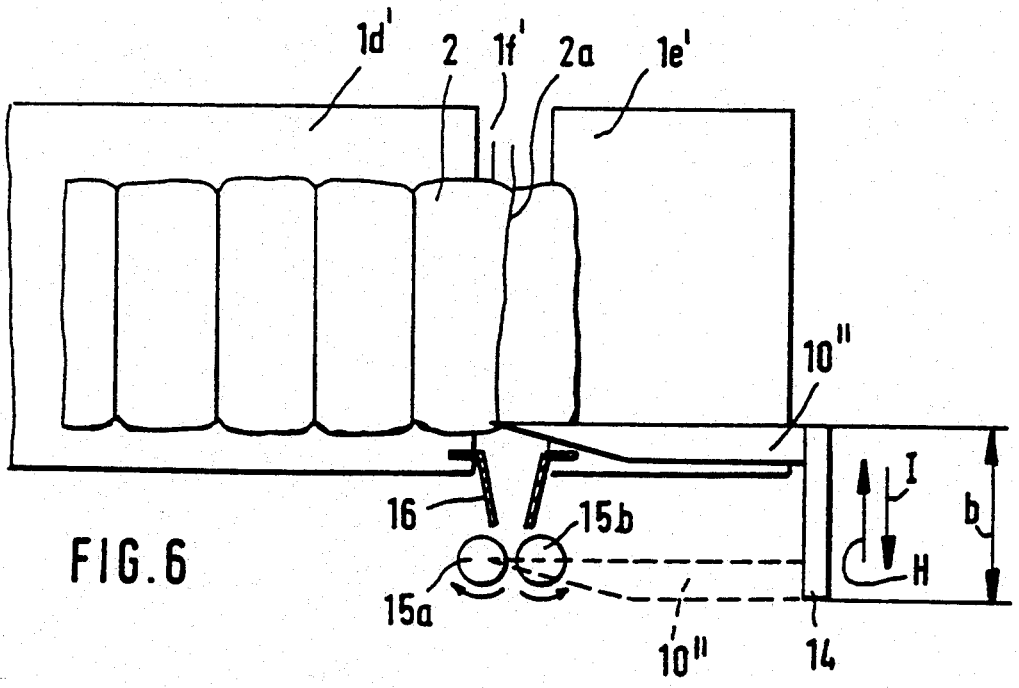
FIG. 6 is a schematic side elevational view of another preferred embodiment, showing a movable spike and two withdrawing rollers.

Turning to FIG. 6, between the two parts 1d' and 1e' of a bale transport track 1' a clearance 1f' is provided. The spike 10" is displaceably secured to a holding device 14 for movement in the direction of the arrows H, I between its solid-line position and its phantom-line position. As the spike 10" is displaced from its solid-line position into its phantom-line position, the severed, engaged tie 2a is drawn by the spike 10" through a distance b from the bale surface to a pull-off roller pair 15a, 15b. Between the bale 2 and the pull-off rollers 15a, 15b a guide element 16 is provided for the ties 2a.

Figure 7A:
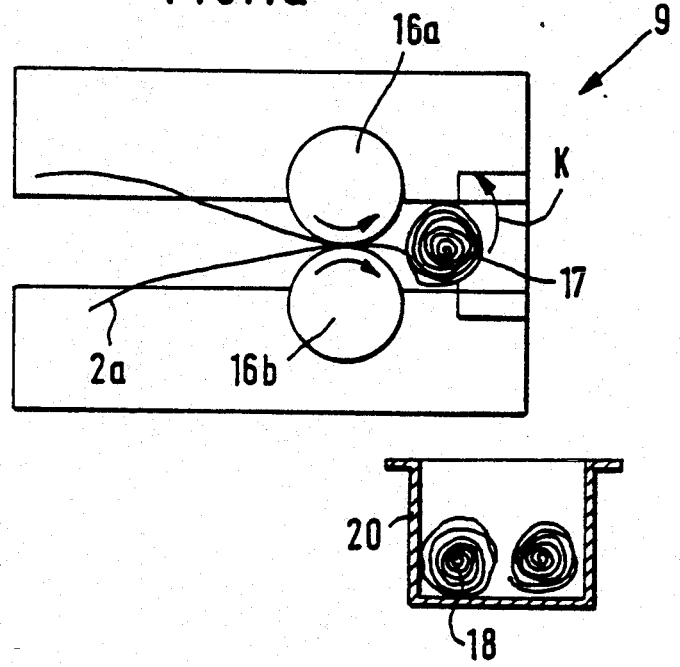
FIG. 7*a* is a schematic side elevational view of a winding device for rolling up the removed ties.
Figure 7B:
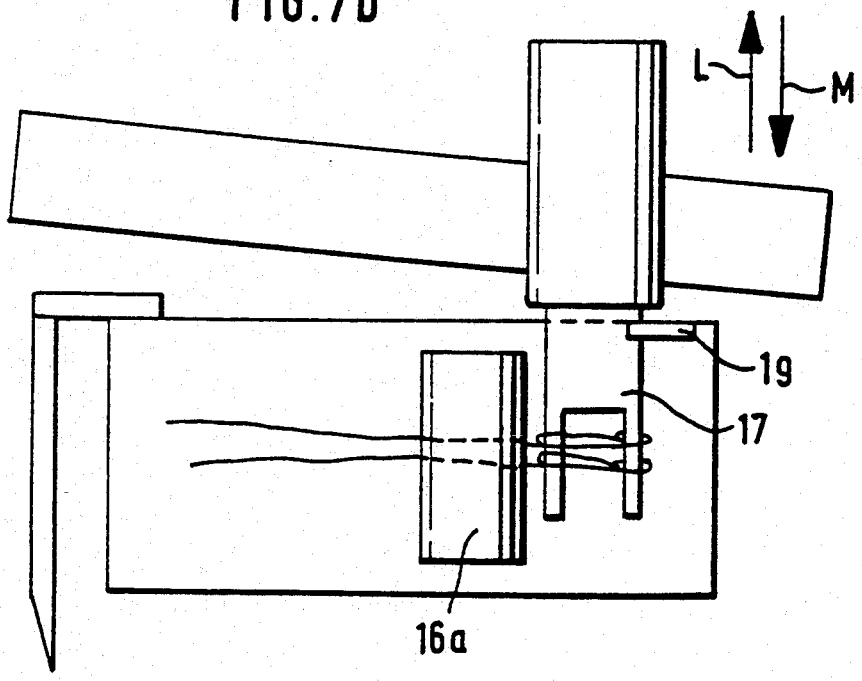
FIG. 7*b* is a schematic top plan view of the construction shown in FIG. 7*a*.

FIG. 7a shows the winding device 9 which has two rotatable conveying rollers 16a and 16b for advancing the removed ties 2a. Downstream of the cooperating rollers 16a and 16b a fork 17 is positioned which is rotatable in the direction of the arrow K and which engages the ties 2a advanced by the rollers 16a and 16b and winds them into a ball 18. The fork 17 is displaceable in the direction of the arrows L and M as shown in FIG. 7b. As the fork 17 is pulled out in the direction of the arrow L, the ball 18 is stopped by a stationary abutment 19 and is thus pulled off the fork 17 and is caused to drop into a container 20.

Figure 8A:
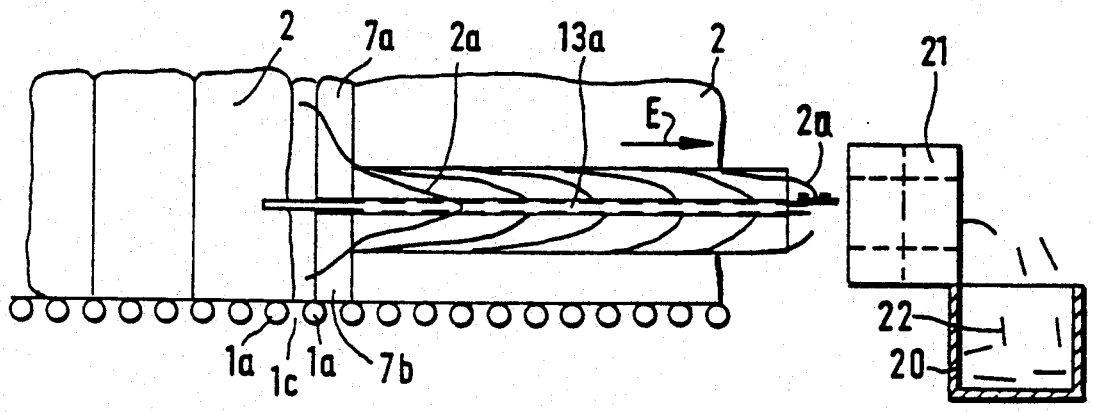
FIG. 8*a* is a view similar to FIG. 5*c*, illustrating additional components.
Figure 8B:
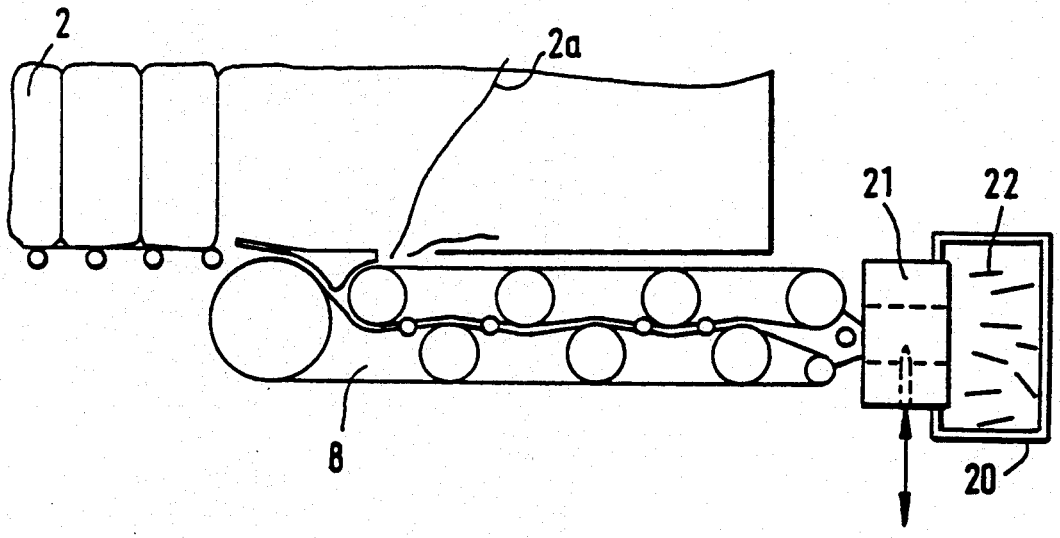
FIG. 8*b* is a schematic top plan view of the structure shown in FIG. 8*a*.

Turning to FIGS. 8a and 8b, downstream of the conveying device 8 transverse shears 21 are provided which cut the ties 2a continuously into small lengths 22 which drop into the container 20. This embodiment has the advantage that internal stresses are immediately removed from the ties 2a and thus the ties do not spread resiliently; such an occurrence could disturb the operation.

It will be understood that the above description of the present invention is susceptible to various modifications, changes and adaptations, and the same are intended to be comprehended within the meaning and range of equivalents of the appended claims.

What is claimed is:

1. An apparatus for removing severed ties and wrapper from a fiber bale, comprising
   (a) a first means for pulling the severed ties and wrapper off the fiber bale;
   (b) a second means for taking over the ties and wrapper from said first means and for conveying the ties and wrapper away from the fiber bale; and
   (c) a winding device situated at a tie discharge end of said second means; said winding device comprises winding means for rolling up the ties received from said second means.

2. An apparatus as defined in claim 1, further comprising comminuting means situated at a tie discharge end of said second means for comminuting ties received from said second means.

3. An apparatus for removing severed ties and wrapper from a fiber bale, comprising
   (a) a first means for pulling the severed ties and wrapper off the fiber bale; said first means comprising a counterelement having a free end and a supported end;
   (b) a second means for taking over the ties and wrapper from said first means and for conveying the ties and wrapper away from the fiber bale;
   (c) advancing means for causing a relative motion between the counterelement and the fiber bale and for causing a penetration of said counterelement into the fiber bale, underneath the ties and wrapper;
   (d) displacing means for supporting said counterelement at said supported end thereof and for displacing said counterelement in a direction transverse to the direction of said relative motion; and
   (e) a pair of cooperating rollers positioned to receive a tie from said counterelement upon movement of the counterelement with the tie away from the fiber bale and to move the tie away from the counterelement.

4. An apparatus as defined in claim 3, wherein said counterelement is spike-shaped.

5. An apparatus as defined in claim 3, wherein said counterelement is elongated and is oriented, with the free end thereof, at an angle against a direction of relative motion of the fiber bale relative to said counterelement.

6. An apparatus for removing severed ties and wrapper from a fiber bale, comprising (a) a first means for pulling the severed ties and wrapper off the fiber bale;

(b) a second means for taking over the ties and wrapper from said first means and for conveying the ties and wrapper away from the fiber bale; said second means comprising a roller having a circumferential zone; said roller cooperating with said first means and engaging a surface of the ties and wrapper; said surface being oriented away from the fiber bale; and (c) carrier means for entraining the ties and wrapper; said carrier means being affixed to said roller along the circumferential zone thereof.

7. An apparatus as defined in claim 6, wherein said carrier means comprises a plurality of pins extending generally radially from said roller.

8. An apparatus for removing severed ties from a fiber bale, comprising (a) conveying means for supporting the fiber bale and for advancing the fiber bale in a first direction;

(b) a stationarily supported counterelement situated adjacent said conveying means and oriented for penetrating into the fiber bale underneath a severed tie and for pulling the severed tie away from the fiber bale;

(c) a first endless belt having a working flight;

(d) first and second end rolls supporting the first belt; said first end roll cooperating with said counterelement for moving away the tie from the fiber bale;

(e) a second endless belt having a working flight; said working flight of said first and second belts being in a coextensive, superpositioned relationship;

(f) third and fourth end rolls supporting the second belt; and (g) drive means for causing circulating travel of said first and second belt such that the working flight of the first belt and the working flight of the second belt co-travel in a second direction for together frictionally engaging and carrying the tie in said second direction away from said first end roll.

9. An apparatus as defined in claim 8, further comprising (h) a first guide roller engaging an underside of the working flight of said first belt; and (i) a second guide roller engaging an underside of the working flight of said second belt.

10. An apparatus as defined in claim 8, further comprising (h) a plurality of first guide rollers spaced from one another in said second direction and engaging an underside of the working flight of said first belt; and (i) a plurality of second guide rollers spaced from one another in said second direction and engaging an underside of the working flight of said second belt; said first guide rollers alternating with said second guide rollers as viewed in said second direction; and said first guide rollers being supported at such a level relative to said second guide rollers so as to impart a wavy path to the working flights of said first and second belts.

11. An apparatus as defined in claim 8, wherein said first and second belts are cross-sectionally wedge-shaped and said first, second, third and fourth end rollers are pulleys with respective peripheral, wedge-shaped grooves for receiving a respective said belt therein.

12. An apparatus as defined in claim 8, wherein said drive means comprises a motor operatively connected to said first end roll.

13. An apparatus as defined in claim 8, wherein at least one of said first and second belts is cross-sectionally wedge-shaped; further wherein at least two of the end rolls are pulleys with respective peripheral, wedge-shaped grooves for receiving the cross-sectionally wedge-shaped belt; further comprising a plurality of tie-carrier pins attached to said at least two end rolls circumferentially on either side of the peripheral groove; said pins extending generally radially from respective said two end rolls.

14. An apparatus as defined in claim 8, further comprising a guide roller engaging an underside of the working flight of one of said first and second belts; said one belt is cross-sectionally wedge-shaped; further wherein said guide roller is a pulley having a peripheral, wedge-shaped groove for receiving the cross-sectionally wedge-shaped belt therein; further comprising a plurality of tie-carrier pins attached to said guide roller circumferentially on either side of the peripheral groove; said pins extending generally radially from said guide roller.

15. An apparatus as defined in claim 8, wherein said first and second directions are parallel and are identically oriented.

* * * * *